United States Patent [19]

Rambow

[11] Patent Number: 4,463,378

[45] Date of Patent: Jul. 31, 1984

[54] BOREHOLE TELEVIEWER DISPLAY

[75] Inventor: Frederick H. K. Rambow, Houston, Tex.

[73] Assignee: Shell Oil Company, Houston, Tex.

[21] Appl. No.: 402,456

[22] Filed: Jul. 27, 1982

[51] Int. Cl.[3] ..... H04N 5/30

[52] U.S. Cl. ..... 358/112; 358/100; 367/69; 364/422; 73/623

[58] Field of Search ..... 358/100, 112; 367/69, 367/71, 75; 73/607, 623; 364/422

[56] References Cited

U.S. PATENT DOCUMENTS

| | | | |
|---|---|---|---|
| 3,369,626 | 2/1968 | Zemanek, Jr. | 346/33 |
| 3,668,619 | 6/1972 | Dennis | 340/15.5 BH |
| 3,718,204 | 2/1973 | Groenendyke | 131/0.5 BE |
| 4,111,055 | 9/1978 | Skidmore | 73/620 |
| 4,276,599 | 6/1981 | Timmons et al. | 364/422 |

*Primary Examiner*—Howard W. Britton
*Assistant Examiner*—John K. Peng

[57] ABSTRACT

A display system for use with a well logging tool of the type that scans a borehole wall by rotating an acoustical transducer while emitting and receiving acoustic energy. The received acoustic or information signals are received and recorded for later use. In addition, both the amplitude and time-of-flight of the information signals are digitized and passed to a computer that controls a television display and cathode ray tube. The amplitude is displayed on the television screen while the time-of-flight is displayed on the cathode ray tube as a caliper log.

12 Claims, 4 Drawing Figures

BOREHOLE TELEVIEWER DISPLAY

BACKGROUND OF THE INVENTION

The present invention relates to well logging and, in particular, to a means for displaying the data obtained from a well logging tool that cyclicly scans the wall of the borehole such as described in U.S. Pat. No. 3,369,626. This type of logging tool referred to as a borehole televiewer or BHTV, emits a pulse of acoustic energy directed at the borehole wall and records the reflected signal. In addition, the tool provides a pulse indicating when the acoustic pulse was initiated and a synchronizing pulse which indicates a geographical direction in each scan of the tool, normally North.

Various types of display systems have been devised for displaying characteristics of the reflected signal which in turn relate to the condition of the borehole wall. For example, in the patent referred to above, the signals are used to control the brightness or Z axis of the oscilloscope trace while the horizontal or X axis sweep is controlled by the sync signal. Thus, a new sweep of the oscilloscope is initiated for each complete scan of the borehole. By photographing the face of the oscilloscope, one obtains a record of the condition of the borehole from which one can locate fractures and similar characteristics.

In U.S. Pat. No. 3,668,619 there is disclosed an improved display system which utilizes an oscilloscope and displays each scan of the borehole as a loop-shaped trace, preferably in an eliptical form. By displaying the traces in this form, one obtains a record which has the appearance of a borehole. The patent also describes systems by which various portions of the eliptical trace may be intensified to illustrate different sections of the borehole wall.

While both of the above display systems provide useful information relating to the condition of a borehole wall, they have several disadvantages. For example, it is impossible to process the data to remove unwanted signals or to emphasize particular characteristics. Further, the only method for obtaining a permanent record is to photograph the face of the oscilloscope. This, of course, eliminates the possibility of re-displaying the data on the oscilloscope face when the operator desires to recheck a portion of the borehole. At times it may be desirable to re-play a portion of the data so that the logging tool can be re-run in certain sections of the borehole prior to leaving a well site.

SUMMARY OF THE INVENTION

The present invention solves the above problems by first recording the signals from the logging tool on a modified conventional television recorder. In particular, the recorder is modified so that the automatic gain controls are eliminated and the true amplitude of the signals recorded. The signals are recorded in the same order in which they are received and thus the recorded signals include the reflected signals as well as the firing pulses and the sync or geographical orientation signals. In addition, signals related to the depth of the logging tool in the borehole are recorded on one of the audio channels of the television recorder. After the signals are recorded, they are supplied to a digitizing circuit wherein the amplitude of the reflected signals is converted to a digital signal. The time of flight of each acoustical pulse from the transmitter to the borehole wall and back to the transmitter is measured and also digitized.

The digital amplitude signals together with the synchronizing or orientation signal are supplied to a conventional computer that is programmed to arrange the digitized amplitude signals in the same order in which they were received. The signals corresponding to one cycle or scan of the tool are arranged to provide one horizontal sweep of a television monitor and each signal is assigned a shade of gray depending upon its amplitude. The computer also stores in its memory the number of cycles corresponding to the number of lines for a complete video display, normally 512 lines. The computer continually replaces the oldest cycle with a new cycle in its memory and retains only the 512 lines. If desired, in addition to being stored in the memory of the computer the processed data could also be stored on magnetic tape or similar recording medium so that the processed data can be viewed at a later time.

In addition to the above, the computer also supplies digitized X-Y coordinate signals in their proper sequence for forming a time-of-flight display on an oscilloscope. A digital-to-analog converter is used to supply the proper X-Y signals for the X and Y axis of the oscilloscope to generate the time-of-flight scan. In this manner, as effective caliper log can be displayed at the same time that the borehole wall condition is being displayed on the television monitor.

BRIEF DESCRIPTION OF THE DRAWINGS

The invention will be more easily understood from the following detailed description when taken in conjunction with the attached drawings in which.

DESCRIPTION OF A PREFERRED EMBODIMENT

Figure 1:
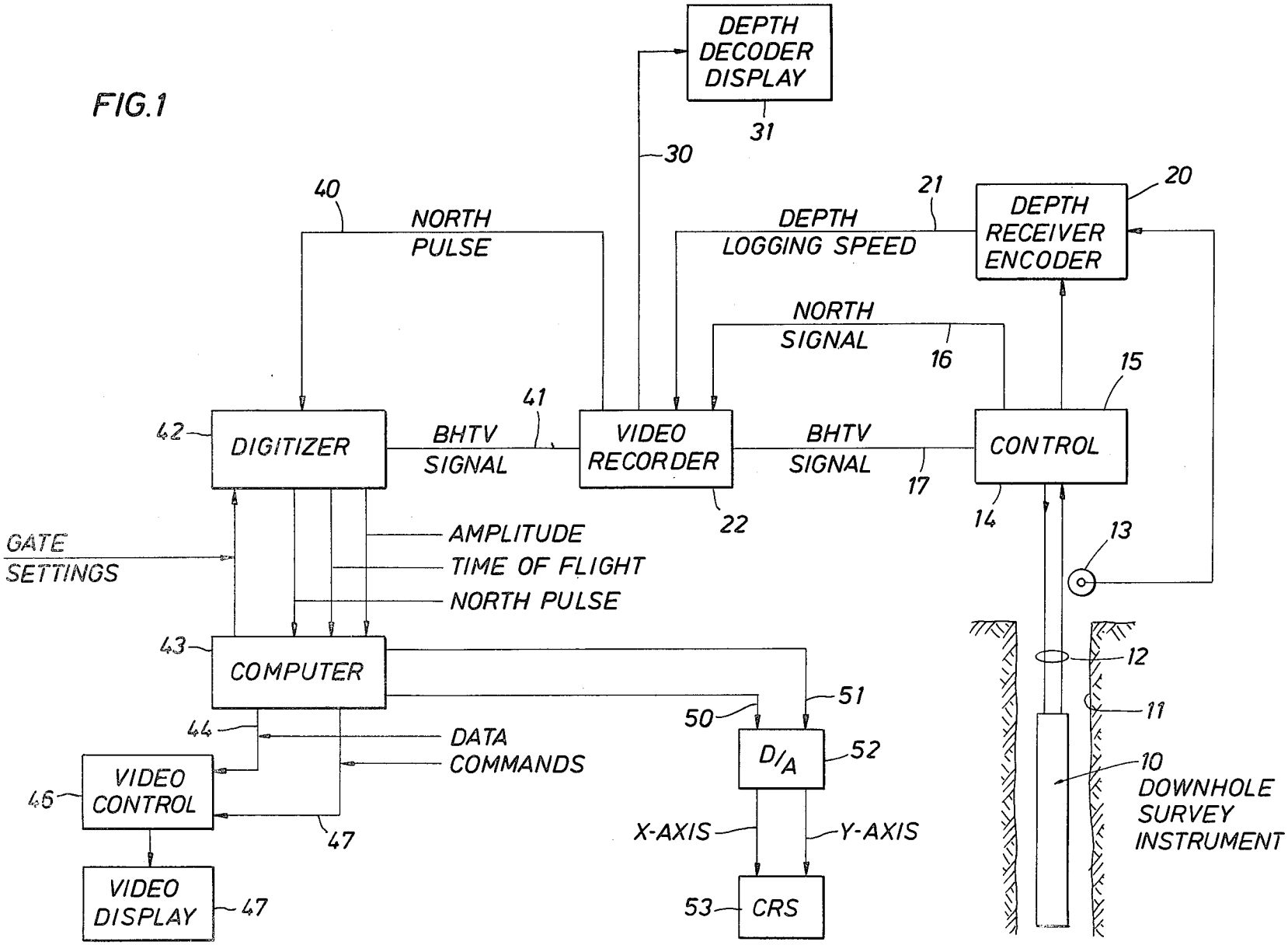
FIG. 1 is a block diagram of the complete system.

Referring to FIG. 1, there is shown a downhole survey instrument 10 positioned in a borehole 11 and connected to the surface by a logging cable 12. As explained above, the downhole tool is similar to that described in U.S. Pat. No. 3,369,626. This tool is provided with a transducer that is rotated to scan the complete circumference of the borehole wall. As the transducer rotates, it emits pulses of acoustical energy which travel radially outward to strike the borehole wall and are reflected back to the transducer which receives the reflected signals and transmits related amplitude signals to the surface. In addition, the tool provides a synchronizing or orientation pulse whenever the transducer rotates past a geographical location, normally North, and a firing pulse each time the transducer is activated. The operation of the tool is controlled from the surface by a control means 14 which transmits power and control signals to the tool and receives the signals from the tool. In addition, a measuring sheave 13 is positioned to measure the length of cable that is paid out as the tool is lowered into the borehole. This, of course, provides a measurement of the location or depth of the tool within the borehole. The control means also supplies output signals 16 and 17 which correspond to the orientation or North signal and the reflected signal respectively. Similarly, the depth signals are supplied to a depth receiver encoder circuit 20 which supplies a digital output signal 21 indicating the depth and the logging speed respectively.

All of the signals are supplied to a video recorder 22 which may be a commercially available video recorder used for home recording of television signals. The video recorder has two substantial modifications; the first being the sync separator is removed and a synthetic synchronizing signal provided from the 30 Hz internal oscillator of the recorder to the input of the vertical sync amplifier. The synthetic sync signal supplies the sync pulse which is expected by the recorder and required for synchronizing the rotating head of the recorder. The second modification is the removal of the internal automatic gain control circuit to prevent the distortion of the received signals which would otherwise occur. The amplitude of the received signals will vary depending upon the centralization of the logging tool in the borehole and the condition of the borehole wall. As will be explained below the amplitude of the received signals in the information desired and any distortion reduces their usefulness. The signals are recorded on the video recorder by recording the amplitude signal on the video channel while the depth and logging speed are recorded on one of the audio channels and the North, or orientation signal, is recorded on the second audio channel.

The depth signal is also transmitted by the video recorder over a line 30 to a depth recording display 31 so that the logging personnel can observe the operation of the logging tool in the borehole. The video recorder also supplies the North pulse, over line 40, and the amplitude signal over line 41 to a digitizing circuit 42 described in more detail below in relation to FIG. 2.

The digitizing circuit supplies digital signals to a computer 43 corresponding to the amplitude of the BHTV signal, the time-of-flight of the signal and the North pulse. The computer 43 in turn supplies gate settings to the digitizer 42 to readjust the length of the gates as explained below in response to changing borehole conditions. The computer arranges the BHTV signals in their proper order and utilizes the North signal as a control signal for the video control 46. The computer also assigns one of 16 shades of gray to each signal depending on its amplitude. The video control in turn supplies a signal to the video monitor or display 47 wherein the BHTV signals corresponding to a complete cycle or scan of the borehole wall are displayed as a line on the screen. The computer stores sufficient lines in its memory to supply a complete monitor picture and when operating in real time, will remove the oldest line and insert the new line in its memory. The synchronizing or beginning of each horizontal sweep of the video screen is controlled by the North signal. Thus, the video display is an image of the borehole wall with the left edge being magnetic north.

The computer also supplies signals over lines 50 and 51 which are the X and Y coordinates for a polar plot on oscilloscope 53. The digital signals are converted by the digital-to-analog converter to analog signals which are then used to control the X and Y axis and luminance of the beam of the oscilloscope so that it, in effect, traces a polar plot that is a cross section of the borehole wall.

Figure 2:
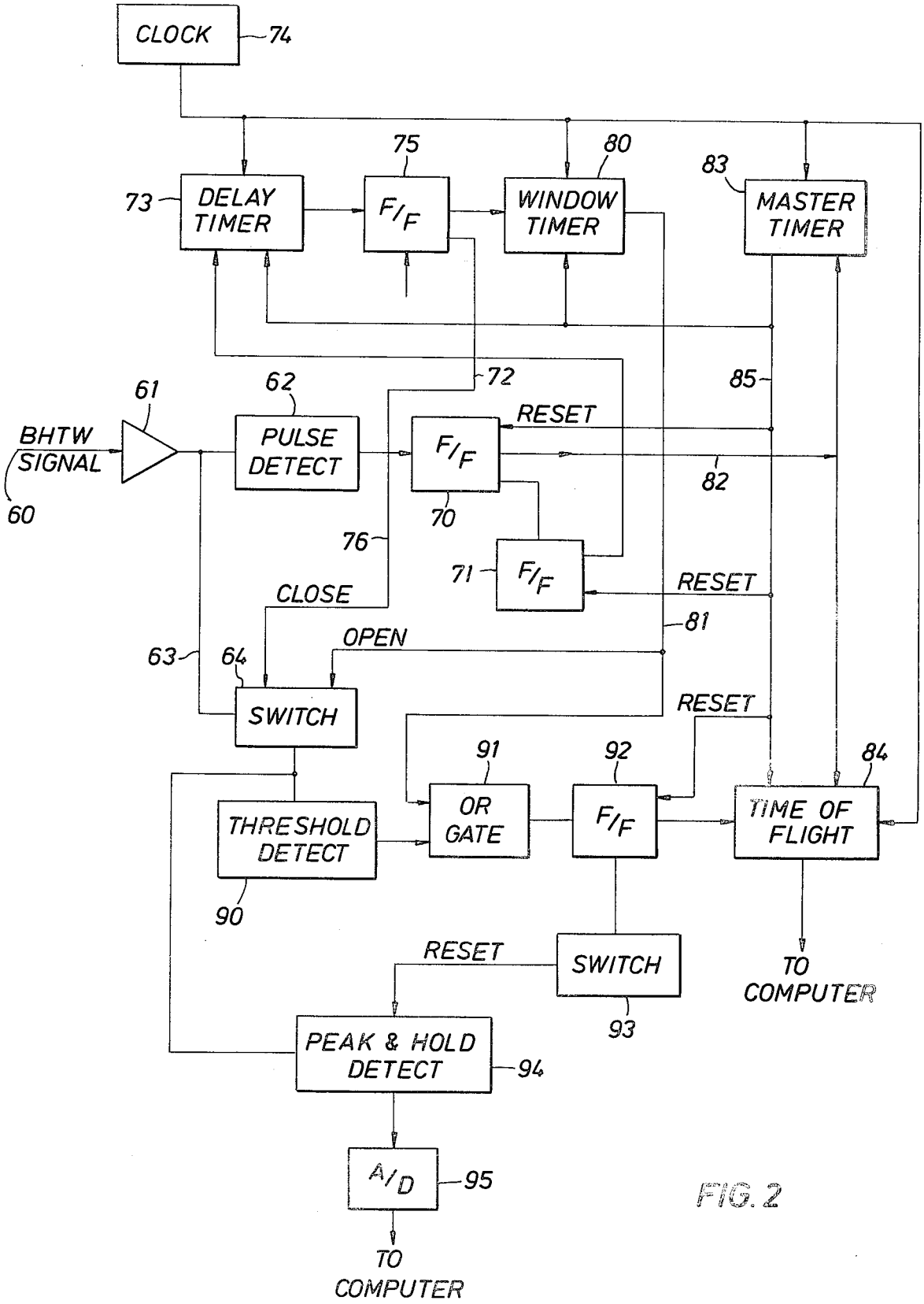
FIG. 2 is a block diagram of the digitizing circuit.
Figure 3A:
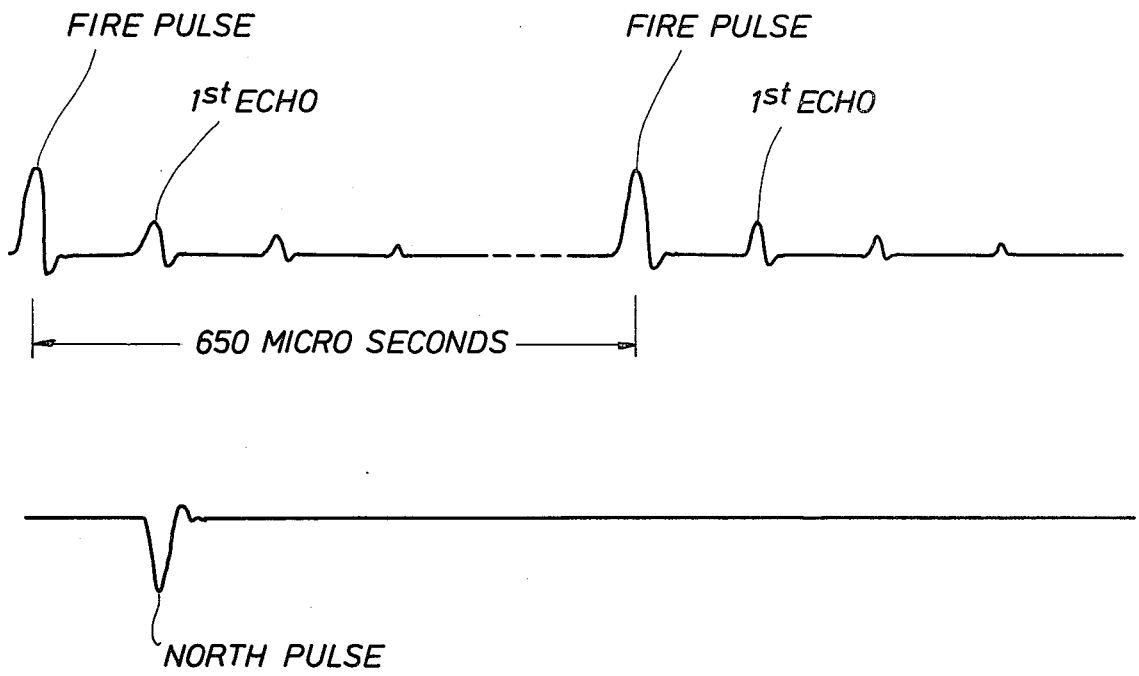
FIG. 3A illustrates the waveforms produced by the downhole tool.
Figure 3B:
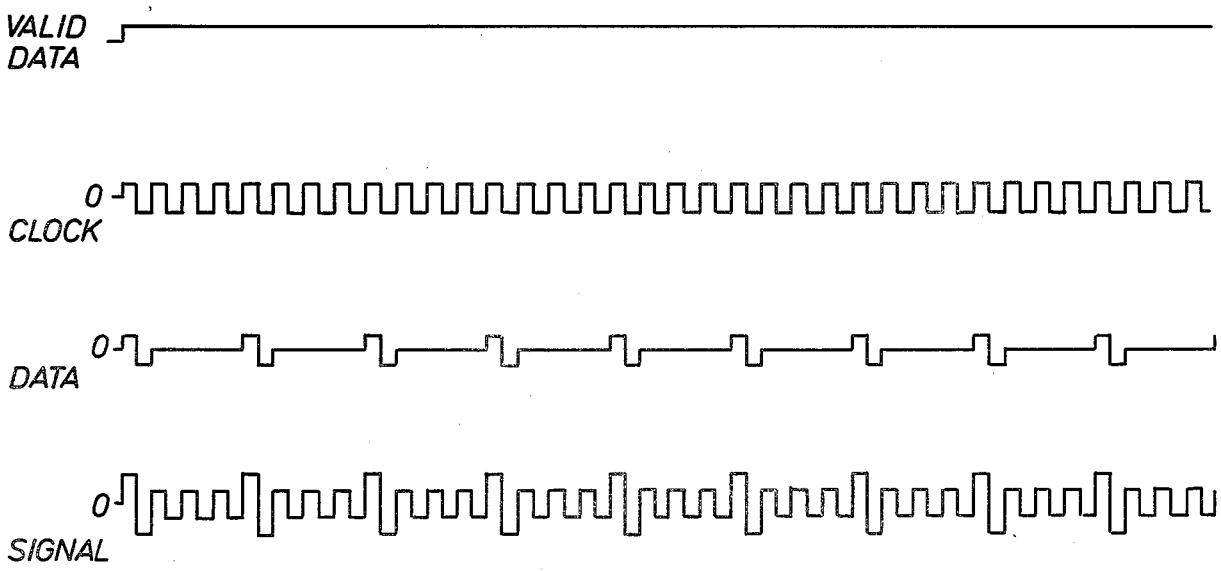
FIG. 3B illustrates waveforms produced by the digitizer circuit of the surface recording apparatus.

Referring to FIGS. 2 and 3, there is shown the details of the digitizing circuits as well as the corresponding wave forms. As shown in FIG. 3A, the signal received from the downhole logging tool includes a fire pulse and one or more echoes or reflected signals. As shown on the drawing the time interval between succeeding fire pulses is 650 microseconds which, as explained above, is controlled by the surface control system. The North or orientation signal is shown as a separate wave form since it is transmitted to the surface over a separate conductor. In addition, the North signal is a negative going signal to assist in separating it from the other signals. Referring to FIG. 2, the BHTV signal 60 is supplied to amplifier 61 which serves as an impedance matching and amplifying device. The amplifier signals are supplied over lead 63 to a switch 64, which will be described below and a pulse detecting circuit 62. The pulse detecting circuit detects the fire pulse and supplies it to a flip flop 70 which, in turn, supplies a signal to a flip flop 71. Flip flop 70 also supplies a signal on the lead 82 to start both a master timer 83 and a time-of-flight indicator 84. The flip flop 71 supplies a signal on line 72 to start a delay timer 73 that is set for a period shorter than the expected time interval between the fire pulse and the first echo. This of course will vary with the diameter of the borehole and normally will be within the range of 60 to 120 microseconds. As explained above, the width or period of the timers can be re-set by the computer as desired depending on changing borehole condition, such as changes in the diameter. It would also be possible to use manually set timers in response to the expected time periods. All of the timers are supplied with clock pulses from the clock 74 which has a frequency of 1 MHz.

When the delay timer 73 times out, it supplies a pulse to the flip flop 75 which starts a window timer 80 and also supplies a signal over lead 76 to close the switch 64. In the closed position the switch can transmit the expected first echo upon receipt to the peak and hold circuit 94. The purpose of the window timer 80 is to supply a second signal over line 81 to open the switch after a preset time interval during which the first echo should have been received. The signal 81 is also supplied to an OR gate 91 which opens the flip flop 92 to stop the time-of-flight timer 84. Normally, the OR gate 91 will be operated by a first echo signal and the signal from the window timer only being used in those instances when the first echo is missing.

After the switch 64 is closed, it will transmit the signal received from the downhole logging tool to a threshold detecting circuit 90 and to a peak and hold circuit 94. Threshold detecting circuit 90 detects the first echo and supplies it to the gate 91 to reposition the flip flop 92 to turn off the time-of-flight timer 84. Thus, the time-of-flight timer will supply output equal to the time required for the acoustic signal to travel from the transducer to the borehole wall and back to the transducer. The switch 64 also supplies a signal to the peak and hold detector 94 which detects the peak amplitude of the echo signal and retains its value. The signal is supplied to an analog-to-digital converter 95 that supplies a related digital signal to the computer shown in FIG. 1. The flip flop 92, in addition to stopping the time-of-flight count, also actuates a switch 93 to reset the peak and hold circuit 94. The remainder of the circuit is reset by the master timer 83 that is set to provide a reset signal before the elapse of the 650 microseconds between the adjacent fire pulses. These reset signals are supplied over the lead 85 and reset the flip flop 70, 71, 75 and 92 as well as reset the counters 73, 80 and 84. This complete circuit is reset prior to the arrival of the next fire pulse which starts a second or subsequent digitizing and time-of-flight measurement. Also, filtering and edge enhancement can be used to improve detection of minute details in the reflected signals.

The North pulse is transformed into a TTL logic signal by an amplifier and comparator circuit (not shown). This signal is transmitted to the computer 43 and used to orient the digitized signals received from the digitizer.

The computer 43, in addition to arranging or formatting the BHTV signals in proper format the display on the monitor 47, can process the BHTV signals. For example, instead of assigning various shades of gray to the BHTV signals, colors related to amplitude could be assigned. Likewise, selected portions of the signal could be emphasized to provide more detail of a portion of the borehole.

What is claimed is:

1. A system for displaying data obtained from cyclicly acoustically scanning the wall of a borehole at a plurality of different depths, each scan of the borehole producing an orientation pulse related to a geographic direction and a series of signals, including a fire pulse and echo signals, whose amplitude is related to the condition of the borehole wall, said system comprising:

a digitizer circuit means, said digitizer circuit being responsive to the fire pulse of each series of signals for initiating a delay period timer and a time-of-flight timer, a peak detecting and hold circuit responsive to the end of the delay period for detecting the peak amplitude of the next occurring echo signal, said time-of-flight timer being stopped upon detection of said peak amplitude to provide a time-of-flight signal;

a computer, said digitizer circuit being coupled to said computer, said computer assigning a shade of gray to each digital signal based on the amplitude represented thereby and arranging of said series of digital signals as a single horizontal line in a television format with each line being initiated by said orientation pulse, said computer storing sufficient series of said signals to form a complete television display; and a television monitor, said computer being coupled to said monitor whereby said monitor displays said series of signals as a continuous display.

2. The apparatus of claim 1 and in addition, a master timer, said master timer being initiated by said fire pulse and preset to time an interval that is shorter than the time between adjacent fire pulses of sequential said series of signals but longer than the time period of said timing cycle, said master timer resetting said digitizer circuits at the end of said preset time.

3. The apparatus of claim 2 and in addition recording means disposed to record said fire pulse, orientation pulse and echo signals in real time and in the sequence in which they are produced, said recorder being coupled to said digitizer circuit to supply signals thereto.

4. The apparatus of claim 1 and in addition a cathode ray oscilloscope, said oscilloscope being coupled to said digitizer to display said time-of-flight signals as a polar plot.

5. The apparatus of claim 4 wherein said polar plot is initiated in response to said orientation pulse.

6. The apparatus of claim 1 wherein said digitizer also includes a window width timer that starts at the end of the delay period and stops after elapse of a time period during which said echo signal should be received, the stopping of said window width timer deactivating said peak detecting and hold circuit.

7. The apparatus of claim 6 wherein the stopping of said window width timer also stops said time-of-flight timer.

8. The apparatus of claim 6 wherein said peak detecting and hold circuit includes a switch means, said switch means being closed at the end of the delay period and opened at the end of the window width period.

9. The apparatus of claim 8 wherein said peak detecting and hold circuit comprises separate threshold detecting and peak and hold detecting circuit.

10. The apparatus of claim 8 wherein said threshold detecting circuit detects the first portion of said echo signal that exceeds a preset level and produces an output signal, said output signal being used to stop said time-of-flight timer.

11. The apparatus of claim 10 and in addition an OR gate, said window width timer and said threshold detecting circuit being coupled to said OR gate, said OR gate being coupled to said time-of-flight timer to stop said time-of-flight timer.

12. The apparatus of claim 11 and in addition a second switch means, said second switch means being coupled to said OR gate and said peak and hold detecting circuit to reset said peak and hold detecting circuit.

* * * * *